US005393358A

United States Patent [19]

Shikanai et al.

[11] Patent Number: 5,393,358

[45] Date of Patent: Feb. 28, 1995

[54] METHOD FOR PRODUCING ABRASION-RESISTANT STEEL HAVING EXCELLENT SURFACE PROPERTY

[75] Inventors: Nobuo Shikanai; Tetsuya Sanpei; Kazunori Yako; Kenji Hirabe; Yasunobu Kunisada, all of Kawasaki, Japan

[73] Assignee: NKK Corporation, Tokyo, Japan

[21] Appl. No.: 98,609

[22] Filed: Jul. 28, 1993

Related U.S. Application Data

[63] Continuation-in-part of Ser. No. 23,865, Feb. 26, 1993, Pat. No. 5,284,529, which is a continuation of Ser. No. 847,723, Mar. 6, 1992, abandoned, which is a continuation-in-part of Ser. No. 621,587, Dec. 3, 1990, abandoned.

[30] Foreign Application Priority Data

Mar. 9, 1993 [JP] Japan ..... 5-047937

[51] Int. Cl.[6] ..... C21D 8/02

[52] U.S. Cl. ..... 148/541; 148/547

[58] Field of Search ..... 148/328, 541, 547; 420/126

[56] References Cited

U.S. PATENT DOCUMENTS 5,236,521 8/1993 Shikanai et al. .
5,284,529 2/1984 Shikanai et al. .

FOREIGN PATENT DOCUMENTS 54-38571 11/1979 Japan .
4-41616 2/1992 Japan .
92/1683 12/1992 South Africa .
92/1684 12/1992 South Africa .
1218927 11/1979 United Kingdom .
2244718 12/1991 United Kingdom .

OTHER PUBLICATIONS

Proceedings of an International Symposium of High-Strength of Low-alloy Steels, Oct. 1975, pp. 55-57, 67, 68, 155 and 156.

*Primary Examiner*—Deborah Yee
*Attorney, Agent, or Firm*—Frishauf, Holtz, Goodman & Woodward

[57] ABSTRACT

An abrasion-resistant steel having excellent surface property consists essentially of 0.1 to 0.45 wt. % C, 0.1 to 1 wt. % Si, 0.1 to 2 wt. % Mn, 0.04 wt. % or less P, 0.04 wt. % or less S, 0.1 to 1 wt. % Ti, 0.0015 to 0.01 wt. % N, and the balance being Fe and inevitable impurities, the steel including at least 400 TiC precipitates of 0.5 μm or more in particle size per 1 $mm^2$ and the steel having Ti* of 0.05 wt. % or more and less than 0.4 wt. % the Ti* being defined by the equations of $Ti^*=Ti(a)-[Ti]$, $Ti(a)=Ti-\{(48/14)N+(48/32)S\}$, $\log[Ti][C]=(-10580/T)+4.38$, $[Ti]=4\times[C]+\{Ti(a)-4\times C\}$.

A method for producing an abrasion-resistant steel having excellent surface property comprising the steps of: preparing a molten steel having the composition specified above; casting continuously the molten steel to produce slab, coarse particles of TiC being precipitated in the slab; hot-working the slab to produce a hot-rolled steel sheet at 1300° C. or less; and quenching the hot-rolled steel sheet.

29 Claims, No Drawings

METHOD FOR PRODUCING ABRASION-RESISTANT STEEL HAVING EXCELLENT SURFACE PROPERTY

CROSS REFERENCE TO RELATED APPLICATION

This is a continuation-in-part application of Ser. No. 08/023,865, filed on Feb. 26, 1993, now U.S. Pat. No. 5,284,529, which is hereby incorporated in its entirety. Application Ser. No. 08/023,865, is a continuation application of Ser. No. 07/847,723, filed Mar. 6, 1992, now abondoned, which is a continuation-in-part application of Ser. No. 07/621,587, filed Dec. 3, 1990, now abandoned.

BACKGROUND OF THE INVENTION

1. Field of the Invention

The present invention relates to an abrasion-resistant steel used for components being subjected to abrasive wear, slip wear, or impact wear caused by rocks, sands, or ores, and to a method for producing thereof, and particularly to an abrasion-resistant steel having excellent surface property and to a method for producing thereof.

2. Description of the Related Arts

Components of industrial machines, their parts, and transportation equipment which are employed in the field of construction, civil engineering, and mining are subjected to abrasive wear, slip wear, or impact wear. These components are made of abrasion-resistant steel to prolong the life of machines, equipment, and parts. It has been known that the increased hardness of steel increases the abrasion resistance of the steel. Accordingly, steel alloys including a large amount of alloying elements such as Cr and Mo are heat-treated to produce high hardness steels.

Japanese Patent Application Laid Open No. 62-142726, 63-169359, and 1-142023 disclosed abrasion-resistant steels to ensure high hardness. These abrasion-resistant steels have approximately 300 or more Brinell hardness at room temperature and have improved weldability, toughness, and bending workability.

The abrasion resistance required to recent abrasion-resistant steels has become much higher level than ever, and conventional method to simply improve the hardness can not satisfy the demand of fundamental improvement of abrasion resistance.

Common practice to increase hardness is the utilization of hardening by solution treatment or by precipitation. However, increase of hardness using an conventional technology of solution treatment, transformation, and precipitation hardening results in degradation of weldability and workability and further in significant cost increase owing to high alloying. Consequently, it is expected to be difficult for a practical use steel to considerably increase its hardness to improve the abrasion resistance.

In conventional steels, Ti is added beside the implementation of precipitation hardening treatment. The purpose of the addition of Ti to steel is mainly to fix N as TiN liable to combine with B in order to secure solution boron effective for quenching hardenability. For example, 0.01 wt. % N content needs about 0.04 wt. % or less Ti addition. When Ti is utilized in a form of TiN, it is sometimes used to prevent the growth of particles to coarse ones during the period of heating the steel to a high temperature. The necessary amount of Ti to prevent the particle growth is about 0.04 wt. % or less. Generally, however, TiN is considered to degrade ductility and toughness. Accordingly, N content of steel is lowered as far as possible at the steel-making process, and the addition of Ti is kept at a minimum level to reduce the amount of generated TiN. The amount of Ti addition is 0.02 wt. % or less.

The above described object of Ti addition and amount of added Ti in conventional technology is summarized below.

(a) With the precipitation hardening using very fine TiC precipitates, the hardness of steel matrix is increased. Then, with the increase of hardness, the abrasion resistance is improved.

(b) In the case that TiN is utilized to improve the hardenability of B or to enhance the generation of fine crystal grains, the Ti addition is kept at approximately 0.04 wt. % or less, and practically at approximately 0.02 wt. % or less.

Since abrasion-resistant steels contact with rocks and ores on their surface under a practical use condition, any surface defect may result in cracks. Accordingly, the surface property is an important factor because cracks occur from surface defects.

SUMMARY OF THE INVENTION

The object of the present invention is to provide an abrasion-resistant steel having an excellent surface property which is obtained by increasing only the abrasion resistance of steel without increasing hardness at a low cost and to provide a method for producing thereof.

To achieve the object, the present invention provides an abrasion-resistant steel having excellent surface property consisting essentially of:

0.1 to 0.45 wt. % C, 0.1 to 1 wt. % Si, 0.1 to 2 wt. % Mn, 0.04 wt. % or less P, 0.04 wt. % or less S, 0.1 to 1 wt. % Ti, 0.015 to 0.01 wt. % N, and the balance being Fe and inevitable impurities;

said steel including at least 400 of TiC precipitates of 0.5 μm or more in particle size per 1 $mm^2$; and the steel having Ti* of 0.05 wt. % or more and less than 0.4 wt. %, said Ti* being specified by the equations of;

$$Ti^* = Ti(a) - [Ti],$$

$$Ti(a) = Ti - \{(48/14)N + (48/32)S\},$$

$$\log[Ti][C] = (-10580/T) + 4.38,$$

$$[Ti] = 4 \times [C] + \{Ti(a) - 4 \times C\},$$

where log[Ti][C]=(−10580/T) +4.38 is an equation designating the temperature dependency of solubility product of TiC, [Ti] designates wt. % of Ti at an equilibrium solubility, [C] designates wt. % of C at an equilibrium solubility, and T designates absolute temperature, Ti, N, S, and C designate wt. % of respective element in the steel.

Furthermore, the present invention provides a method for producing an abrasion-resistant steel having excellent surface property comprising:

preparing a molten steel having the composition of 0.1 to 0.45 wt. % C, 0.1 to 1 wt. % Si, 0.1 to 2 wt. % Mn, 0.04 wt. % or less P, 0.04 wt. % or less S, 0.1 to 1 wt. % Ti, 0.0015 to 0.01 wt. % N, and the balance being Fe and inevitable impurities, said steel having Ti* of 0.05 wt. % or more and less than 0.4 wt. %, said Ti* being specified by the equations of;

$$Ti^* = Ti(a) - [Ti],$$

$$Ti(a) = Ti - \{(48/14)N + (48/32)S\},$$

$$\log[Ti][C] = (-10580/T) + 4.38,$$

$$[Ti] = 4 \times [C] + \{Ti(a) - 4 \times C\},$$

where $\log[Ti][C] = (-10580/T) + 4.38$ is an equation designating the temperature dependency of solubility product of TiC, [Ti] designates wt. % of Ti at an equilibrium solubility, [C] designates wt. % of C at an equilibrium solubility, T designates absolute temperature, and Ti, N, S, and C designate wt. % of respective element in the steel;

casting continuously said molten steel to produce slab, coarse particles of TiC being precipitated in the slab;

hot-working the slab to produce a hot-rolled steel sheet at a temperature of 1000° to 1300° C.; and quenching the hot-rolled steel sheet.

DESCRIPTION OF THE PREFERRED EMBODIMENT

The inventors studied the conditions to improve abrasion resistance without increasing hardness. From the point of increasing solely abrasion resistance, it was found effective to generate precipitates consisting mainly of coarse TiC by adding a great amount of titanium to steel during the solidification stage. It is inexpensive to improve the abrasion resistance by means of the principle described thereabove because expensive alloying elements are not required. However, the generation of these coarse precipitates has problems listed below.

(a) In an ingot casting process, the solidification rate is very slow, which remarkably enlarges the precipitated particles. The precipitates are dropped out during practical application so that it can not improve the abrasion resistance. The effective precipitate size is 50 μm or less.

(b) In the ingot casting process, the finally solidified portion includes a large amount of Ti, and it is difficult to obtain a uniformly distributed precipitate throughout the steel ingot.

(c) For a steel to which was added a large amount of Ti during the casting, heating or hot rolling stage, the oxidation is markedly accelerated at near the surface compared with ordinary steel, which significantly degrades the surface property because Ti is a strong oxidizing element.

The present inventors made further study to solve these three problems and found that the problems of (a) and (b) could be solved by employing continuous casting process and that the problem of (c) could be solved by controlling the value of parameter Ti* which is described below.

This invention is based on a concept which is quite different from that for conventional abrasion-resistant steel. In a conventional abrasion-resistant steel which abrasion resistance was improved by an increased hardness, the object of Ti addition is the precipitation hardening through the formation of fine TiC precipitate. To utilize the precipitation hardening, the size of TiC precipitate is necessary to limit to 0.1 μm or less. For the precipitation of those fine particles, it is necessary that titanium is dissolved and thereafter precipitates of TiC are formed. Practically, titanium-is dissolved during the heating stage at hot, rolling process or during heat treatment, and precipitates of TiC are formed during the rolling stage or during the heat treatment such as tempering.

According to the present invention, the abrasion resistance is significantly improved by applying a large amount of Ti which positively forms a lot of coarse precipitates consisting mainly of TiC during the solidification stage in the continuous casting. The steel of the present invention utilizes the precipitate consisting mainly of TiC having 0.5 μm or more in size. For instance, the steel of the present invention utilizes the precipitate of TiC or the composite precipitate of TiC and TiN or TiS. This type of coarse precipitate consisting mainly of TiC, which has not been investigated, has a high hardness and is able to improve considerably the abrasion resistance.

To function the precipitation hardening as well as in prior art, the size of precipitate is necessary to maintain at 0.1 μm or less level. The precipitates having 0.5 μm or more in size which are specified by the present invention do not contribute to the precipitation hardening at all. In the present invention, the presence of coarse precipitates decreases the matrix hardness. That is an important feature of the present invention along with the feature of excellent abrasion resistance. In other words, the precipitates consisting mainly of large amount of TiC reduce the amount of soluble C, which reduces the hardness of matrix in steel by the generation of the precipitate. -The reduced hardness improves the bending workability. Accordingly, the steel of the present invention has another feature of superiority in both abrasion resistance and formability. From the practical point of view, the upper limit of hardness is 600 Brinell hardness at the most. In a range of higher than 600 Brinell hardness, however, the effect of coarse precipitates to improve abrasion resistance is observed. Therefore, when there is no need of bending workability, the .improvement of abrasion resistance using the similar concept with the present invention is possible.

For the utilization of the effect of coarse precipitates, it is important to prevent the precipitates or composite precipitates, consisting mainly of coarse TiC having 0.5 μm or larger size formed during the solidification stage of continuous casting process, from dissolving in the succeeding process as far as possible. Practically, at a heating temperature during hot working or at a heat treatment temperature which are approximately 1300° C. or less, the precipitates and composite precipitates consisting mainly of TiC are required to exist at a sufficient stability. For a steel containing Nb and V, the precipitates of Nb(C, N) or V(C, N) present also in the coarse precipitates, and the composite precipitate containing Ti, Nb, and V simultaneously presents, too. From the view point of abrasion resistance, the precipitate of Ti group is most effective, and the precipitates of Nb group and the precipitates of V group are also effective.

As described above, the present invention was derived from the standpoint of improving the abrasion resistance without increasing hardness. The present invention is also applicable to the components having a low hardness and requiring workability. In this respect, the present invention is unique and quite different from conventional abrasion-resistant steels. In concrete terms, when compared at the same degree of hardness, the abrasion resistance of conventional steels is considerably inferior to that of the steel of the present invention. Inversely, when the abrasion resistance is emphasized, conventional steels need to significantly increase their hardness, which makes the conventional steels practically impossible for applying for the components which must have a good workability.

The problems of excessive growth of precipitate and of nonuniform distribution of precipitates are expected to occur when the abrasion resistance is improved by forming Ti group coarse precipitates. The problems can be solved by applying the continuous casting process. Compared with the ingot casting process, the continuous casting process gives a high solidification rate, so the coarse precipitates are uniformly distributed and excessively coarse precipitate is not formed. As a result, the size of coarse precipitates becomes around 0.5–20 μm. In other words, the continuous casting process allows steel to include a large amount of coarse precipitates of a size not to easily be dropped out during practical use and distribute the precipitates uniformly. Consequently, the abrasion resistance of the steel produced by continuous casting process gives more stable precipitates and more uniform distribution of precipitates than those of the abrasion-resistant steel produced by ingot casting process. Accordingly, the abrasion resistance of the steel produced by continuous casting process is favorable.

Since the steel of the present invention includes a large amount of Ti, the oxidation at the region near the surface is markedly accelerated compared with ordinary steel, which may considerably degrade the surface property. However, the degradation of surface property was found to be successfully improved by controlling the parameter expressed by Ti*. By keeping the value of Ti* within specified range, both favorable abrasion resistance and excellent surface property can be assured. It is possible to improve solely the abrasion resistance by increasing the value of Ti* over the specified upper limit. In the case of larger value of Ti* than specified range, however, the surface property degrades and the it is impossible to put the steel to practical use.

The following is the description of reasons to specify the composition range.

C: 0.1 to 0.45 wt. %

Carbon is an indispensable element to form precipitates consisting mainly of TiC. Addition of less than 0.1 wt. % C does not effectively form the precipitates consisting mainly of TiC. Excess addition of C over 0.45 wt. % increases hardness and degrades weldability and workability. Accordingly, the C content is specified to 0.1 to 0.45 wt. %.

Si: 0.1 to 1 wt. %

Silicon is an effective element as deoxidizer. For a sufficient deoxidizing effect, addition of at least 0.1 wt. % Si is needed. Silicon is also an element effective to enhance the solution hardening. However, Si content above 1 wt. % degrades toughness and increases inclusions in steel. Consequently, the Si content is specified to 0.1 to 1 wt. %.

Mn: 0.1 to 2 wt. %

Manganese is an effective element from the standpoint of quench hardenability. To obtain an effect of quench hardenability, the addition of 0.1 wt. % or more Mn is necessary. The addition of Mn over 2 wt. %, however, degrades weldability. Therefore, the Mn content is specified to 0.1 to 2 wt. %.

P: 0.04 wt. % or less

Since P is an impurity element and since it degrades toughness, the content of P is preferable to keep as low as possible. Minimizing the P content, however, markedly increases the production cost. Thus, from the view point of preventing bad influence and of suppressing the cost increase, the P content is specified to 0.04 wt. % or less.

S: 0.04 wt. % or less

Addition of large amount of S degrades hot rolling property and toughness. Therefore, the S content is desirable to keep as low as possible. The minimizing the S content, however, markedly increases the production cost. Thus, from the view point of preventing bad influence and of suppressing the cost increase, the S content is specified to 0.04 wt. % or less.

Ti: 0.1 to 1 wt. %

Titanium is, in the present invention, one of the most important elements along with C, and is an inevitable element to form coarse precipitates consisting mainly of TiC. With respect to the formation of these coarse precipitates, at least 0.1 wt. % of Ti content is necessary. When the Ti content exceeds 1 wt. %, the abrasion resistance is kept at a favorable level but the production cost is increased and weldability and workability are degraded. Accordingly, the Ti content is specified to 0.1 to 1 wt. %.

N: 0.0015 to 0.01 wt. %

Similar with S, N forms precipitates and has an effect to makes the uniform distribution of TiC easy. In addition, the hardness of TiN itself is high, which improves the abrasion resistance. However, the N content less than 0.0015 wt. % does not give these effects, so the N content is desirably at 0.0015 wt. % or more. Above 0.01 wt. % N addition degrades both surface property and weldability. Consequently, the N content is preferably at 0.01 wt. % or less, and more preferably in a range of 0.0015 to 0.01 wt. %.

According to this invention, at least one element selected from the group consisting of 0.1 to 2 wt. % Cu, 0.1 to 10 wt. % Ni, 0.1 to 3 wt. % Cr, 0.1 to 3 wt. % Mo, and 0.0003 to 0.01 wt. % B may be contained other than the elements described before.

Cu: 0.1 to 2 wt. %

Copper is an element to enhance quenching hardenability, and an effective element to control hardness for each use. Less than 0.1 wt. % Cu addition can not give the effect. Over 2 wt. % Cu addition degrades hot workability and increases the production cost. Consequently, when Cu is applied, the Cu content is specified to 0.1 to 2 wt. %.

Ni: 0.1 to 10 wt. %

Nickel is an element to improve quenching hardenability and toughness at a low temperature. Less than 0.1 wt. % Ni addition can not give the effect. Over 10 wt. % Ni addition increases the production cost markedly. Therefore, when Ni is applied, the Ni content is specified to 0.1 to 10 wt. %.

Cr: 0.1 to 3 wt. %

Chromium is an element to improve quenching hardenability. Less than 0.1 wt. % Cr addition can not give the effect. Above 3 wt. % Cr addition degrades weldability and increase the production cost. Consequently, when Cr is applied, the Cr content is specified to 0.1 to 3 wt. %.

Mo: 0.1 to 3 wt. %

Molybdenum is an element to improve quenching. hardenability. Less than 0.1 wt. % Mo addition can not give the effect. Above 3 wt. % of Mo addition degrades weldability and increase the production cost. Consequently, when Mo is applied, the Mo content is specified to 0.1 to 3 wt. %.

B: 0.0003 to 0.01 wt. %

Boron is an element to improve quenching hardenability with a slight addition. Less than 0.0003 wt. % B addition can not give the effect. Above 0.01 wt. % B addition degrades weldability and quenching hardenability. Consequently, when B is applied, the B content is specified to 0.0003 to 0.01 wt. %.

According to the invention, the basic composition or composition with the addition of selected elements described thereabove may further contain at least one element selected from the group consisting of 0.005 to 1 wt. % Nb and 0.01 to 1 wt. % V.

Nb: 0.005–1 wt. %

Niobium is an element effective for the precipitation hardening and an element to control the strength of steel for each use. In addition, Nb is effective to form coarse precipitates similar to Ti. However, less than 0.005 wt. % Nb addition can not give the effects. Above 1 wt. % Nb addition degrades weldability. Consequently, when Nb is applied, the Nb content is specified to 0.005 to 1 wt. %.

V: 0.01–1 wt. %

Vanadium is an element effective for the precipitation hardening and an element to control the strength of steel for each use. In addition, V is effective to form coarse precipitates similar to Ti. However, less than 0.01 wt. % V addition can not give the effects. Above 1 wt. % V addition degrades weldability. Consequently, when V is applied, the V content is specified to 0.01 to 1 wt. %.

The steel of the present invention is specified by the composition described above and also by the size and number of precipitates. The steel is required to include the 400 or more coarse precipitates having 0.5 μm or more particles consisting mainly of TiC per 1 $mm^2$. The abrasion resistance, the most important characteristic of the present invention, is provided by forming a large amount of coarse precipitates or composite precipitates consisting mainly of TiC. However, the precipitates less than 0.5 μm give less effect to improve the abrasion resistance, and small precipitates induce the increase of hardness or strength caused by the precipitation hardening. Therefore, the softening effect in matrix owing to the precipitation can not be expected with precipitates smaller than 0.5 μm. Accordingly, the required size of coarse precipitates is 0.5 μm or more. In addition, even when there are precipitates having 0.5 μm or more, less than 400 of them per 1 $mm^2$ give very little effect to improve the abrasion resistance. Conclusively, the precipitates consisting mainly of TiC are specified as 0.5 μm or more of their size and 400 or more of their number per 1 $mm^2$.

However, since the coarse precipitates containing Ti of more than 50 μm in size are liable to drop out, the effect of the abrasion resistance cannot be expected. Besides this, since the toughness of steel is greatly decreased when such extremely coarse precipitates are present in steel in large quantities, it is better that the coarse precipitates containing Ti of more than 50 μm in size are not present in steel. The number of precipitates of over 4000 per 1 $mm^2$ saturates the effect.

Furthermore, the value of Ti* defined by the following equations is required to 0.05 wt. % or more and less than 0.4 wt. %.

$$Ti^* = Ti(a) - [Ti] \quad (1)$$

$$Ti(a) = \mathrm{Ti} - \{(48/14)N + (48/32)S\} \quad (2)$$

$$\log[Ti][C] = (-10580/T) + 4.38 \quad (3)$$

$$[Ti] = 4 \times [C] + \{Ti(a) - 4 \times C\} \quad (4)$$

where log[Ti][C]=(−10580/T)+4.38 is an equation designating the temperature dependency of solubility product of TiC, and [Ti] designates wt. % of Ti at an equilibrium solubility, and [C] designates wt. % of C at an equilibrium solubility, and T designates absolute temperature., and Ti, N, S, and C designate wt. % of respective element in the steel. Ti* is amount of precipitate including TiC. Ti(a) is amount of Ti which does not form titanium nitride or titanium sulfide. Equation (4) designates the precipitation amount of TiC by stoichiometry.

The amount expressed by Ti* is a parameter designating the condition to secure the specified amount of precipitates consisting mainly of TiC and to stably secure the excellent surface property. Within the Ti* range of 0.05 wt. % or more and less than 0.4 wt. %, a favorable abrasion resistance and excellent surface property can be secured. The value of less than 0.05 wt. % Ti* degrades the abrasion resistance, and the value of 0.4 wt. % or more significantly degrades the surface property, though the abrasion resistance is kept at a favorable level.

Slab produced by continuous casting process is preferably used in the present invention. In the production of high Ti content steel ordinary ingot gives very slow solidification rate, which enhances the segregation at the ingot core and at the top portion. Furthermore, the precipitates consisting mainly of TiC concentrates to the segregated portion and to the final solidified zone, which inhibits the realization of uniform characteristics throughout the final product. On the other hand, with a slab prepared by continuous casting process which gives a high solidification rate, the TiC precipitates and composite precipitates can be uniformly dispersed compared with the ingot. Accordingly, the slab is preferably produced by continuous casting process in the present invention. From the view point of production cost, the continuous casting process is advantageous.

The following is the method for producing the abrasion-resistant steel of the present invention.

The molten steel having the composition specified in the description on the steel of the present invention and having the specified range of the value of Ti* is continuously casted. At the continuous casting stage, coarse precipitates consisting mainly of TiC are formed. The slab is heated at a temperature of 1300° or less so that the coarse precipitates consisting mainly of TiC existing in the slab will not dissolve and not precipitate again.

In the continuous casting, the molten steel having the composition specified in the description on the steel of this invention and having the specified range of the value of Ti* is applied. The continuous casting is performed using the molten steel under an ordinary continuous casting condition. As a result, the precipitates consisting mainly of TiC and having desired size and number are formed in the slab during the continuous casting stage.

The important thing in the hot working and quenching stage following the continuous casting is to prevent the coarse precipitates consisting mainly of. TiC and being formed during the continuous casting process from dissolving again and precipitating again. Nevertheless, even when the coarse precipitates are dissolved again to some extent, if the parameter Ti* satisfies the condition of 0.05% or more and less than 0.4 wt. %, then the re-precipitation does not substantially occur and no problem occurs. From the point to prevent the coarse precipitates consisting mainly of TiC from dissolving again and precipitating again, the heating temperature is preferably low. However, a markedly low heating temperature degrades the hot ductility and makes the rolling difficult and lowers the productivity. Therefore, heating temperature of 1000° to 1300° C. is specified. From the point of obtaining a desired precipitates, 1200° C. or less temperature is preferred, and 1100° C. or less temperature is more preferable. When the heating temperature exceeds 1300° C., oxidation during heating considerably proceeds. In particular, the steel of the present invention includes a large amount of Ti, which enhances the generation of oxide scale and results in the degradation of surface property. Accordingly, the heating temperature is limited to 1300° C. or less. Less than 1000° C. degrades hot-workability and makes it difficult to roll the slab into a predetermined shape in dimension.

The steel which has been finished by heating and hot-working into a specified shape is quenched in the final product stage. The object of quenching is to utilize the transformation hardening and to stabilize the abrasion resistance. For a conventional steel, the quenching enhanced the transformation hardening too much and degraded the workability and weldability. In the present invention, however, a large amount of coarse precipitates lowers the matrix hardness, which is capable of suppressing the increase of hardness.

EXAMPLE

Slab or ingot was prepared by continuous casting or ingot casting. The slab or ingot was heated to a specified temperature, followed by hot working and quenching to obtain the steel having the composition shown in Table 1(a) and 1(b). The steels 1 through 22 in Table 1 (a) are the examples within the range of the present invention, and the steels A through K are the comparison outside the scope of the present invention.

Table 2(a) and 2(b) show the steel making conditions. The symbol "CC" in Table 2(a) designates the continuous casting process, and the symbol "ING" designates the ingot casting process. AH the steels of examples were produced by continuous casting process, :and a part of the comparative examples were produced by ingot casting process. The heating temperature was selected to several levels within the range of 1000° to 1250° C. The quenching was carded out in a temperature range of 850° to 970° C. Table 2(b) also gives the number of precipitates. The number designates the number of precipitates consisting mainly of TiC and having 0.5 μm or more in size per 1 $mm^2$ of area.

The steels produced following the process was measured to determine Brinell hardness and was tested for their abrasion resistance and surface property. The abrasion resistance was determined by an abrasion test in accordance with ASTM G-65, while abrasion resistance ratio was derived specifying the abrasion resistance of SS400 mild steel as 1.0. Larger abrasion resistance ratio gives superior abrasion resistance. At the abrasion test, 100% $SiO_2$ was employed as the abrasive sand. Regarding the surface property, surface defect having 0.2 mm or more of depth is counted as the defect. The area rate of surface defect is calculated to judge the surface property based on the following criteria.

o: the total defective area is less than $25cm^2/m^2$ x: the total defective area is $25cm2/m^2$ or more.

The result is given in Table 2(b).

As seen in Table 2(b), the steels 1 through 22 which satisfy the range specified in the present invention were confirmed to have high abrasion resistance ratio and favorable surface property, though the surface hardness was relatively low. On the contrary, the steels of A through D, comparative examples having a low Ti content outside of the specification of this invention gave a low abrasion resistant ratio. In particular, the comparative steels of A, B, and D gave no precipitate and were confirmed to give no effect of the precipitates, which effect is the most important feature of the present invention. As a result, the steels of comparative examples gave very poor abrasion resistance and showed no characteristics as abrasion-resistant steel, though they have a good surface property. As for the comparative steel C, the low Ti content and few precipitate number set the abrasion resistance ratio very low compared with, for example, the example steel 4.

The comparative steels E and K are corresponding to the example 5 and 9, respectively. Although these comparative steels E and K satisfy the composition specification of the present invention and satisfy the condition of specified range of Ti*, they were ,produced by ingot casting process. Because very coarse precipitates were formed, they gave a poor surface property, and degraded abrasion resistance compared with the corresponding example steels. When the comparative steels E and K are compared with the example steels 5 and 9 for the amount of precipitates, the steels E and K gave a large precipitates, which reduced the number of precipitates compared with the steels 5 and 9. The reason why the abrasion resistance of steels E and K was inferior to that of steels 5 and 9 is that the significantly large precipitates were dropped out under an abrasion condition.

The method of production of steels F through J was continuous casting process, but their value of Ti* was out of the scope of the present invention. As a result, their abrasion resistance was favorable but the surface property was markedly degraded, and they were confirmed to be inapplicable for practical use.

As described in detail above, the present invention improves the abrasion resistance at a low production cost without increasing hardness, and the present invention provides a method of producing the abrasion-resistant steel having excellent surface property giving less surface defects which is the initiating point of crack. Consequently, the life of machines and their components is prolonged, which machines and components suffered a short life owing to severe wear and crack generation during operation.

TABLE 1 (a)

| | Composition (wt. %) | | | | | | | |
|---|---|---|---|---|---|---|---|---|
| | C | Si | Mn | P | S | Cu | Ni | Cr |
| Example | | | | | | | | |
| 1 | 0.14 | 0.75 | 1.30 | 0.015 | 0.012 | | | |
| 2 | 0.24 | 0.41 | 1.07 | 0.018 | 0.011 | | | |
| 3 | 0.83 | 0.23 | 0.96 | 0.010 | 0.007 | | | |
| 4 | 0.31 | 0.30 | 0.99 | 0.009 | 0.018 | | | |
| 5 | 0.35 | 0.27 | 0.85 | 0.010 | 0.008 | | | |
| 6 | 0.12 | 0.88 | 1.41 | 0.026 | 0.019 | | | |
| 7 | 0.14 | 0.52 | 1.88 | 0.022 | 0.006 | 0.65 | | |
| 8 | 0.21 | 0.42 | 1.32 | 0.012 | 0.010 | 0.38 | 0.59 | |
| 9 | 0.33 | 0.29 | 0.83 | 0.006 | 0.004 | | | 0.98 |
| 10 | 0.35 | 0.42 | 0.76 | 0.010 | 0.027 | | 0.99 | |
| 11 | 0.44 | 0.50 | 1.12 | 0.019 | 0.010 | | 0.77 | |
| 12 | 0.31 | 0.42 | 0.76 | 0.011 | 0.007 | 0.18 | 0.12 | 0.23 |
| 13 | 0.40 | 0.12 | 0.51 | 0.019 | 0.003 | | 1.22 | 0.51 |
| 14 | 0.19 | 0.29 | 1.23 | 0.010 | 0.025 | | | |
| 15 | 0.33 | 0.16 | 1.54 | 0.012 | 0.010 | | | |
| 16 | 0.35 | 0.40 | 0.72 | 0.009 | 0.004 | | | |
| 17 | 0.43 | 0.32 | 0.55 | 0.002 | 0.007 | | | |
| 18 | 0.38 | 0.27 | 0.66 | 0.007 | 0.030 | 1.31 | 0.52 | |
| 19 | 0.30 | 0.31 | 0.89 | 0.006 | 0.025 | | | 0.82 |
| 20 | 0.25 | 0.76 | 0.33 | 0.015 | 0.006 | 0.25 | 0.69 | 0.42 |
| 21 | 0.34 | 0.23 | 0.72 | 0.011 | 0.004 | | | 0.12 |
| 22 | 0.15 | 0.28 | 0.62 | 0.012 | 0.028 | | 1.81 | 0.31 |
| Comparative example | | | | | | | | |
| A | 0.14 | 0.48 | 1.90 | 0.012 | 0.007 | 0.69 | | |
| B | 0.21 | 0.30 | 0.65 | 0.015 | 0.007 | | 1.78 | 0.29 |
| C | 0.32 | 0.34 | 1.02 | 0.009 | 0.012 | | | |
| D | 0.33 | 0.42 | 0.88 | 0.007 | 0.003 | | | 1.01 |
| E | 0.35 | 0.30 | 0.88 | 0.012 | 0.007 | | | |
| F | 0.36 | 0.35 | 1.12 | 0.012 | 0.009 | | | |
| G | 0.30 | 0.48 | 1.30 | 0.010 | 0.010 | | | |
| H | 0.32 | 0.37 | 1.03 | 0.017 | 0.002 | | | |
| I | 0.39 | 0.21 | 0.85 | 0.008 | 0.003 | | | |
| J | 0.29 | 0.38 | 0.72 | 0.007 | 0.005 | | 0.27 | 1.53 |
| K | 0.34 | 0.30 | 0.92 | 0.006 | 0.007 | | | 0.94 |

TABLE 1 (b)

| | Composition (wt. %) | | | | | | |
|---|---|---|---|---|---|---|---|
| | Mo | Ti | Nb | V | B | N | Ti* |
| Example | | | | | | | |
| 1 | | 0.28 | | | | 0.0058 | 0.193 |
| 2 | | 0.43 | | | | 0.0042 | 0.369 |
| 3 | | 0.12 | | | | 0.0056 | 0.076 |
| 4 | | 0.21 | | | | 0.0038 | 0.153 |
| 5 | | 0.38 | | | | 0.0063 | 0.330 |
| 6 | | 0.66 | | | | 0.0084 | 0.394 |
| 7 | | 0.37 | | | | 0.0044 | 0.281 |
| 8 | | 0.43 | | | | 0.0029 | 0.367 |
| 9 | 0.20 | 0.40 | | | 0.0007 | 0.0053 | 0.357 |
| 10 | | 0.47 | | | 0.0015 | 0.0062 | 0.390 |
| 11 | | 0.44 | | | | 0.0070 | 0.388 |
| 12 | 0.12 | 0.43 | | | 0.0013 | 0.0038 | 0.385 |
| 13 | 0.83 | 0.42 | | | | 0.0044 | 0.386 |
| 14 | | 0.51 | 0.029 | | | 0.0085 | 0.394 |
| 15 | | 0.40 | 0.180 | | | 0.0069 | 0.343 |
| 16 | | 0.27 | 0.320 | 0.510 | | 0.0083 | 0.220 |
| 17 | | 0.13 | 0.580 | 0.150 | | 0.0027 | 0.099 |
| 18 | | 0.50 | 0.930 | 0.040 | 0.0006 | 0.0042 | 0.390 |
| 19 | 0.27 | 0.28 | 0.091 | 0.770 | | 0.0044 | 0.209 |
| 20 | 0.15 | 0.44 | 0.110 | 0.100 | 0.0011 | 0.0032 | 0.390 |
| 21 | 1.32 | 0.18 | 0.420 | 0.230 | 0.0022 | 0.0040 | 0.145 |
| 22 | 0.25 | 0.52 | | 0.340 | | 0.0064 | 0.376 |
| Comparative example | | | | | | | |
| A | | 0.05 | | | | 0.0041 | 0.000 |
| B | 0.28 | 0.04 | | 0.330 | | 0.0052 | 0.000 |
| C | | 0.06 | | | | 0.0043 | 0.013 |
| D | | 0.03 | | | 0.0008 | 0.0050 | 0.000 |
| E | | 0.39 | | | | 0.0070 | 0.339 |
| F | | 0.49 | | | | 0.0052 | 0.441 |
| G | | 0.62 | | | | 0.0021 | 0.569 |
| H | | 0.95 | | | | 0.0072 | 0.878 |
| I | | 1.21 | | | | 0.0030 | 1.151 |
| J | | 0.51 | | | | 0.0048 | 0.460 |

TABLE 1 (b)-continued

| | Composition (wt. %) | | | | | | |
|---|---|---|---|---|---|---|---|
| | Mo | Ti | Nb | V | B | N | Ti* |
| K | 0.21 | 0.41 | | | 0.0007 | 0.0049 | 0.365 |

TABLE 2 (a)

| Steel | Production method | Heating temperature | Hardening temperature |
|---|---|---|---|
| 1 | CC | 1150 | 900 |
| 2 | CC | 1150 | 900 |
| 3 | CC | 1230 | 870 |
| 4 | CC | 1230 | 900 |
| 5 | CC | 1180 | 920 |
| 6 | CC | 1180 | 950 |
| 7 | CC | 1200 | 920 |
| 8 | CC | 1200 | 950 |
| 9 | CC | 1200 | 900 |
| 10 | CC | 1000 | 900 |
| 11 | CC | 1050 | 900 |
| 12 | CC | 1250 | 900 |
| 13 | CC | 1250 | 880 |
| 14 | CC | 1180 | 950 |
| 15 | CC | 1150 | 850 |
| 16 | CC | 1150 | 900 |
| 17 | CC | 1150 | 850 |
| 18 | CC | 1180 | 970 |
| 19 | CC | 1200 | 900 |
| 20 | CC | 1200 | 900 |
| 21 | CC | 1200 | 900 |
| 22 | CC | 1200 | 900 |
| A | CC | 1200 | 880 |
| B | CC | 1200 | 900 |
| C | CC | 1200 | 900 |
| D | CC | 1200 | 900 |
| E | 1 NC | 1180 | 900 |
| F | CC | 1250 | 900 |
| G | CC | 1180 | 900 |
| H | CC | 1200 | 900 |
| I | CC | 1150 | 950 |
| J | CC | 1150 | 900 |
| K | 1 NC | 1150 | 900 |

TABLE 2 (b)

| Steel | Number of precipitates | HB | Abrasion resistance ratio | Surface property |
|---|---|---|---|---|
| 1 | 1382 | 352 | 5.2 | ○ |
| 2 | 2224 | 390 | 8.7 | ○ |
| 3 | 824 | 522 | 7.6 | ○ |
| 4 | 1205 | 481 | 8.1 | ○ |
| 5 | 2057 | 461 | 10.1 | ○ |
| 6 | 2623 | 296 | 5.3 | ○ |
| 7 | 1982 | 321 | 5.5 | ○ |
| 8 | 2389 | 366 | 8.0 | ○ |
| 9 | 2340 | 454 | 11.2 | ○ |
| 10 | 2360 | 462 | 10.9 | ○ |
| 11 | 3188 | 495 | 11.7 | ○ |
| 12 | 2448 | 438 | 10.2 | ○ |
| 13 | 3222 | 457 | 10.7 | ○ |
| 14 | 1894 | 423 | 10.0 | ○ |
| 15 | 2650 | 415 | 9.1 | ○ |
| 16 | 2714 | 477 | 9.0 | ○ |
| 17 | 2942 | 503 | 7.7 | ○ |
| 18 | 3401 | 351 | 7.8 | ○ |
| 19 | 1860 | 454 | 8.3 | ○ |
| 20 | 2991 | 380 | 8.7 | ○ |
| 21 | 911 | 401 | 6.0 | ○ |
| 22 | 2593 | 370 | 8.2 | ○ |
| A | 0 | 395 | 3.2 | ○ |
| B | 0 | 441 | 3.8 | ○ |
| C | 270 | 518 | 4.5 | ○ |
| D | 0 | 530 | 4.6 | ○ |
| E | 992 | 469 | 8.2 | X |
| F | 2719 | 454 | 11.3 | X |
| G | 3249 | 378 | 10.5 | X |
| H | 4860 | 323 | 12.3 | X |
| I | 6204 | 309 | 13.1 | X |
| J | 2815 | 420 | 10.6 | X |

TABLE 2 (b)-continued

| Steel | Number of precipitates | HB | Abrasion resistance ratio | Surface property |
|---|---|---|---|---|
| K | 1032 | 432 | 8.8 | X |

What is claimed is:

1. A method for producing an abrasion-resistant steel having excellent surface property comprising the steps of:

preparing a molten steel consisting essentially of 0.1 to 0.45 wt. % C, 0.1 to 1 wt. % Si, 0.1 to 2 wt. % Mn, 0.04 wt. % or less P, 0.04 wt. % or less S, 0.1 to 1 wt. % Ti, 0.0015 to 0.01 wt. % N, and the balance being Fe and inevitable impurities, said steel having Ti* of 0.05 wt. % or more and less than 0.4 wt. %, said Ti* being specified by equations of;

$$Ti^* = Ti(a) - [Ti],$$

$$Ti(a) = Ti - \{(48/14)N + (48/32)S\},$$

$$\log[Ti][C] = (-10580/T) + 4.38,$$

$$[Ti] = 4 \times [C] + \{Ti(a) - 4 \times C\},$$

where log[Ti][C]=(−10580/T)+4.38 is an equation designating the temperature dependency of solubility product of TiC, [Ti] designates wt. % of Ti at an equilibrium solubility, [C] designates wt. % of C at an equilibrium solubility, T designates an absolute temperature, and Ti, N, S, and C designate wt. % of a respective element in the steel;

casting continuously said molten steel to produce slab, coarse particles of TiC being precipitated in the slab;

hot-working the slab to produce a hot-rolled steel sheet at 1300° C. or less; and quenching the hot-rolled steel sheet.

2. The method of claim 1, wherein said steel further includes at least one element selected from the group consisting of 0.1 to 2 wt. % Cu, 0.1 to 10 wt. % Ni, 0.1 to 3 wt. % Cr, 0.1 to 3 wt. % Mo, and 0.0003 to 0.01 wt. % B.

3. The method of claim 1, wherein said steel further includes at least one element selected from the group consisting of 0.005 to 1 wt. % Nb and 0.01 to 1 wt. % V.

4. The method of claim 1, wherein said steel further includes at least one element selected from the group consisting of 0.1 to 2 wt. % Cu, 0.1 to 10 wt. % Ni, 0.1 to 3 wt. % Cr, 0.1 to 3 wt. % Mo, 0.0003 to 0.01 wt. % B, 0.005 to 1 wt. % Nb, and 0.01 to 1 wt. % V.

5. The method of claim 1, wherein said hot-working is carried out at a temperature range of from 1000 ° C. to 1250° C.

6. The method of claim 1, wherein said quenching is carded out at a temperature range of from 850° C. to 970° C.

7. The method of claim 4, wherein said hot-working is carried out at a temperature range of from 1000° C. to 1250° C.; and said quenching is carried out at a temperature range of from 850° C. to 970° C.

8. The method of claim 7, wherein said steel consists essentially of 0.14% C, 0.75% Si, 1.30% Mn, 0.015% P, 0.012% S, 0.28% Ti and 0.0058% N; and 0.193% Ti*, all % being wt. %.

9. The method of claim 7, wherein said steel consists essentially of 0.24% C, 0.41% Si, 1.07% Mn, 0.018% P, 0,011% S, 0.43% Ti and 0.0042% N; and 0.369% Ti*, all % being wt. %.

10. The method of claim 7, wherein said steel consists essentially of 0.33% C, 0.23% Si, 0.96% Mn, 0.010% P, 0.007% S, 0.12% Ti and 0.0056% N; and 0.076% Ti*, all % being wt. %.

11. The method of claim 7, wherein said steel consists essentially of 0.31% C, 0.30% Si, 0.99% Mn, 0.009% P, 0.018% S, 0.21% Ti and 0.0038% N; and 0.153% Ti*, all % being wt. %.

12. The method of claim 7 wherein said steel consists essentially of 0.35% C, 0.27% Si, 0.85% Mn, 0.010% P, 0.008% S, 0.38% Ti and 0.0063% N; and 0.330% Ti*, all % being wt. %.

13. The method of claim 7, wherein said steel consists essentially of 0.12% C, 0.38% Si, 1.41% Mn, 0.026% P, 0.019% S, 0.66% Ti and 0.0084% N; and 0.394% Ti*, all % being wt. %.

14. The method of claim 1, wherein said steel consists essentially of 0.14% C, 0.52% Si, 1.88% Mn, 0.022% P, 0.006% S, 0.65% Cu, 0.37% Ti and 0.0044% N; and 0.281% Ti*, all % being wt. %.

15. The method of claim 7, wherein said steel consists essentially of 0.21% C, 0.42% Si, 1.32% Mn, 0.012% P, 0.010% S, 0.38% Cu, 0.59% Ni, 0.43% Ti and 0.0029% N; and 0.367% Ti*, all % being wt. %.

16. The method of claim 7, wherein said steel consists essentially of 0.33% C, 0.29% Si, 0.83% Mn, 0.006% P, 0 004% S, 0.98% Cr, 0.20% Mo, 0.40% Ti, 0.0007% B and 0.0053% N; and 0.357% Ti*, all % being wt. %.

17. The method of claim 7, wherein said steel consists essentially of 0.35% C, 0.42% Si, 0.76% Mn, 0.010% P, 0.027% S, 0.99 Ni, 0.47% Ti, 0 0015% B and 0.0062% N; and 0.390% Ti*, all % being wt. %.

18. The method of claim 7, wherein said steel consists essentially of 0.44% C, 0.50% Si, 1.12% Mn, 0.019% P, 0.010% S, 0.77% Ni, 0.44% Ti and 0.0070% N; and 0.388% Ti*, all % being wt. %.

19. The method of claim 7, wherein said steel consists essentially of 0.31% C, 0.42% Si, 0.76% Mn, 0.011% P, 0.007% S, 0.18% Cu, 0.12% Ni, 0.23% Cr, 0.12% Mo, 0.43% Ti, 0.0013% B and 0.0038% N; and 0.385% Ti*, all % being wt. %.

20. The method of claim 7, wherein said steel consists essentially of 0.40% C, 0.12% Si, 0.51% Mn, 0.019% P, 0.003% S, 1.22% Ni, 0.51% Cr, 0.83% Mo, 0.42% Ti and 0.0044% N; and 0.386% Ti*, all % being wt. %.

21. The method of claim 7, wherein said steel consists essentially of 0.19% C, 0.29% Si, 1.23% Mn, 0.010% P, 0.025% S, 0.51% Ti, 0.029% Nb and 0.0085% N; and 0.394% Ti*, all % being wt. % .

22. The method of claim 7, wherein said steel consists essentially of 0.33% C, 0.16% Si, 1.54% Mn, 0.012% P, 0.010% , S 0.40% Ti, 0.180% Nb and 0.0069% N; and 0.343% Ti*, all % being wt. %.

23. The method of claim 7, wherein said steel consists essentially of 0.35% C, 0.40% Si, 0.72% Mn, 0.009% P, 0.004% S, 0.27% Ti, 0.320% Nb, 0.510% V and 0.0083% N; and 0.220% Ti*, all being wt. %.

24. The method of claim 7, wherein said steel consists essentially of 0.43% C, 0.32% Si, 0.55% Mn, 0.002% P, 0.007% S, 0.13% Ti, 0.580% Nb, 0.150% V and 0.0027% N; and 0.099% Ti*, all being wt. %.

25. The method of claim 7, wherein said steel consists essentially of 0.38% C, 0.27% Si, 0.66% Mn, 0.007% P, 0.030% S, 1.31% Cu, 0.52% Ni, 0.50% Ti, 0.930% Nb, 0.040% V, 0.0006% B and 0.0042% N; and 0.390% Ti*, all % being wt. %.

26. The method of claim 7, wherein said steel consists essentially of 0.30% C, 0.31% Si, 0.89% Mn, 0.006% P, 0.025% S, 0.82% Cr, 0.27% Mo, 0.28% Ti, 0.091% Nb. 0.770% V and 0.0044% N; and 209% Ti*, all % being wt. %.

27. The method of claim 7, wherein said steel consists essentially of 0.25% C, 0.76% Si, 0.33% Mn, 0.015% P, 0.006% S, 0.25% Cu, 0.69% Ni, 0.42% Cr, 0.15% Mo, 0.44% Ti, 0.110% Nb, 0.100% V, 0.0011% B and 0.0032% N; and 0.390% Ti*, all % being wt. %.

28. The method of claim 7, wherein said steel consists essentially of 0.34% C, 0.23% Si, 0.72% Mn, 0.011% P, 0.004% S, 0.12% Cr, 1.32% Mo, 0.18% Ti, 0.420% Nb, 0.230% V, 0.0022% B and 0.0040% N; and 0.145% Ti*, all % being wt. %.

29. The method of claim 7, wherein said steel consists essentially of 0.15% C, 0.28% Si, 0.62% Mn, 0.012% P, 0.028% S, 1.81% Ni, 0.31% Cr, 0.25% Mo, 0.52% Ti, 0.340% V and 0.0064% N; and 0.376% Ti*, all % being wt. %.

* * * * *